US011656031B2

(12) United States Patent
Zanardi et al.

(10) Patent No.: US 11,656,031 B2
(45) Date of Patent: May 23, 2023

(54) JUNCTIONS FOR DOUBLE-WALLED TUBES IN HEAT EXCHANGERS AND EXCHANGERS WITH SUCH JUNCTIONS

(71) Applicant: HEXSOL ITALY SRL, Bergamo (IT)

(72) Inventors: Luca Zanardi, Bergamo (IT); Fabiano Foglieni, Calusco d'Adda (IT)

(73) Assignee: HEXSOL ITALY SRL, Bergamo (IT)

( * ) Notice: Subject to any disclaimer, the term of this patent is extended or adjusted under 35 U.S.C. 154(b) by 232 days.

(21) Appl. No.: 17/287,342

(22) PCT Filed: Dec. 19, 2019

(86) PCT No.: PCT/IB2019/061111

§ 371 (c)(1),
(2) Date: Apr. 21, 2021

(87) PCT Pub. No.: WO2020/128957

PCT Pub. Date: Jun. 25, 2020

(65) Prior Publication Data

US 2021/0381774 A1 Dec. 9, 2021

(30) Foreign Application Priority Data

Dec. 20, 2018 (IT) ..... 102018000020257

(51) Int. Cl.
*F28D 7/10* (2006.01)
*F28F 9/02* (2006.01)
(Continued)

(52) U.S. Cl.
CPC ..... *F28D 7/106* (2013.01); *F28F 9/0229* (2013.01); *F28F 9/182* (2013.01); *F28D 2021/0056* (2013.01)

(58) Field of Classification Search
CPC ..... F28D 7/106; F28D 2021/0056; F28F 9/0229; F28F 9/182
(Continued)

(56) References Cited

U.S. PATENT DOCUMENTS 3,610,329 A 10/1971 Markert et al.
4,848,449 A 7/1989 Brücher et al.
(Continued)

FOREIGN PATENT DOCUMENTS

CA 986918 4/1976
DE 2 403 713 8/1974
(Continued)

OTHER PUBLICATIONS

International Search Report dated Apr. 22, 2020 in International (PCT) Application No. PCT/IB2019/061111.

*Primary Examiner* — Davis D Hwu
(74) *Attorney, Agent, or Firm* — Wenderoth, Lind & Ponack, L.L.P.

(57) ABSTRACT

In a heat exchanger with double-walled tubes, an end junction between inner tube and outer tube comprises an end plate in which there is a seat in which an end portion of the inner tube is housed. The corresponding outer tube is peripherally fixed sealingly around the opening of the seat and a deflector extends the inner wall of the outer tube inside the seat so as to define a toroidal cavity between the deflector and a side wall of the seat. The seat is closed by a bottom which is opposite to the opening of the seat and which has a passage connected sealingly to the end of the inner tube in the seat for the transit of the fluid to be cooled. A radial space is present near the said bottom between the toroidal cavity and internal cavity of the double-walled tube, and the end plate has at least one conduit which emerges inside the toroidal cavity for the inflow or outflow of the cooling fluid. In this way a junction and an exchanger with such a junction which are robust and have innovative performance features may be provided.

22 Claims, 7 Drawing Sheets

(51) Int. Cl.
*F28F 9/18* (2006.01)
*F28D 21/00* (2006.01)

(58) Field of Classification Search
USPC ..... 165/157
See application file for complete search history.

(56) References Cited

U.S. PATENT DOCUMENTS

| | | | | |
|---|---|---|---|---|
| 4,997,211 | A | 3/1991 | Brücher et al. | |
| 8,672,021 | B2 | 3/2014 | Montestruc, III | |
| 2006/0048725 | A1 | 3/2006 | Schotz | |
| 2009/0260586 | A1* | 10/2009 | Geskes ..... | F02M 26/22 165/104.19 |
| 2010/0319888 | A1 | 12/2010 | Birk et al. | |

FOREIGN PATENT DOCUMENTS

| | | |
|---|---|---|
| DE | 39 10 630 | 10/1990 |
| DE | 196 22 139 | 12/1997 |
| DE | 10 2009 025 624 | 12/2010 |
| DE | 102009057954 A1 * | 6/2011 |
| EP | 0 290 812 | 11/1988 |
| EP | 1 310 758 | 5/2003 |
| EP | 1 559 953 | 8/2005 |
| GB | 2 057 666 | 4/1981 |

* cited by examiner

JUNCTIONS FOR DOUBLE-WALLED TUBES IN HEAT EXCHANGERS AND EXCHANGERS WITH SUCH JUNCTIONS

The present invention relates to junctions for double-walled tubes in heat exchangers. Moreover, the present invention relates to exchangers provided with such junctions.

In the sector of exchangers, exchangers of the type with double-walled tubes are known. These exchangers comprise a plurality of double-walled tubes each formed by an inner tube inside which the fluid to be cooled flows and an outer tube coaxial with the inner tube so as form a cavity inside which the cooling fluid flows. Especially in the case of exchangers with double-walled tubes operating at high temperatures (even higher than 650° C. and generally in the region of 900° C.), such as the exchangers intended to perform quenching of the hot fumes output from ethylene production ovens, the junction at the ends of the tubes for connecting each inner tube and the cavity between the tubes to the respective fluids is particularly critical. In fact, in the connection zone, the temperature of the connected tubes varies significantly within the space of a few centimetres.

As regards the critical part, namely the end connections of the double-walled tubes, the double-walled tube exchangers may be basically divided up into two main categories.

In the first category each double-walled tube has a special Y-shaped piece, namely a connecting piece having a double-walled tubular end and an opposite single-walled end for connecting one of the N linear outputs of the radiant element with the inner tube and for forming at the same time an annular chamber at the end of the cavity between outer tube and inner tube, with this chamber which is connected to the cooling fluid flow (for example a water+steam mixture).

This type of junction has the drawback that the temperature gradient in the Y-junction is extremely high since the temperature varies within a few millimetres from the value of the hot fumes (for example at about 900° C.) to the value of the cooling fluid (usually boiling water corresponding to the working pressure) with a temperature range which is certainly critical for the metals used and which results for example in ageing of the material.

Moreover, the zone of the connecting welds may be difficult to cool, even if two cooling fluid inlets are present; and this also worsens the thermal stressing of the junction (local increases in temperature).

In an attempt to limit the drawbacks of this first type of connection, in the second category of double-walled exchangers a sleeve is added inside the part of the special single-walled Y-shaped piece. This sleeve has a free end so as to be able to expand axially, being exposed on the inner side to the full temperature of the incoming hot fumes (for example at 900° C.) and an opposite end welded onto an extension of the single-walled Y-shaped piece. The annular ring thus formed between sleeve and Y-shaped piece is filled with heat insulation, for example formed by multiple layers of refractory material of varied conductivity (in order to ensure a small temperature gradient in the conical part of the Y-shaped piece), or by diluting steam which is at a slightly higher pressure than the hot fumes (said steam forms a near-stagnant insulating cavity, part thereof being mixed with the hot fumes escaping above the sleeve).

The advantage of this solution with insulation consists in the reduced thermal stresses in the outer cylinder of the Y-shaped piece (lower temperature gradient), which is protected by the insulation layer. Despite its greater complexity, this solution is therefore hitherto the one which is most widely used.

It has, however, the drawback of potential infiltration of particulate matter (coke) due to the sleeve which is not sealed off from the hot fluid flow. Such infiltration may in turn result in distortion of the sleeve and in some cases cause cracking thereof. Thus this solution also does not deal with the existing problems.

Furthermore, in all the design solutions present on the market the design of the inlet for the cooling fluid (for example saturated water) into the cavity of the double-walled tubes and also the design of the outlet for said fluid at the opposite end of the exchanger (where generally the cooling fluid is a balanced mixture of liquid and steam) remains a critical aspect.

Essentially the known inlet systems, but also outlet systems (for easier comprehension reference will be made below to inlet systems) may be summarised as follows:

- an oval chamber for distribution of the cooling fluid, with one or two linear-end inlets, which supplies in series/sequence the annular chamber situated between the outer tube and the inner tube of each double-walled tube;
- one or two cooling fluid distribution nozzles which supply the annular chamber situated between the outer tube and the inner tube of each double-walled tube; said nozzles being able to be located flush with the zone of the Y-shaped union which connects the inner tube and the outer tube or at a greater height with respect to the bottom of the water chamber (but always at a height of less than 200 mm), with an internal conveyor which forces a vertical flow of the fluid (usually near-saturated water) before the bottom of the annular chamber is reached. The inlet nozzles may then be perfectly aligned with the axis of the tubes (namely the axis of the nozzle(s) intersects the longitudinal axis of the inner tube and the outer tube) or may be eccentric so as to create a rising helical movement.

In all the solutions, however, from a fluid-dynamic point of view, the circular symmetry (namely the same flow in each angular portion) is not guaranteed and physiologically zones with a depressed/stagnant flow are present, these becoming even more critical as mentioned in the type of union, without thermal insulation, of the Y-shaped piece.

A completely different type of exchanger consists of shell-and-tube exchangers, which are often referred to as exchangers of the TLE type (Transfer Line Exchangers), while the tube exchangers with double-walled tubes are often called exchangers of the PQE type (Primary Quench Exchangers) or LQE type (Linear Quench Exchangers).

Expressed very simply, where the outflow from the radiant ovens occurs via a single opening, the installation of TLEs with tube bundle is required, while PQEs with double-walled tubes are used where the outflow from the ovens occurs via multiple openings which are spaced close together in one or more staggered rows.

The decision as to the type of oven is the responsibility of the engineering company specialized in oven design; the supplier of the downstream apparatus (i.e. the TLEs or PQEs) is therefore required to install sometimes TLEs and sometimes PQEs.

The two types of exchangers, while providing the same service (rapid quenching of hot fumes and steam production) are however very different from each other. The PQEs tend to be much longer than the TLEs and have much bigger through-flow/outflow cross-sections for the hot fumes; such that, for the same length, the dwell times of the fumes is much shorter in the PQEs than in the TLEs. This reduces the soiling due to the formation of coke and allows much longer operating cycles in ovens equipped with PQEs rather than with TLEs.

It would therefore on occasions be preferable to use PQEs, but this is incompatible with the connection needs of the exchanger, which are instead satisfied by the TLEs.

However, both in PQEs and in TLEs there exist among other things the problems which are summarised below:

- high erosion caused by the gas due to the conveying of solid particulate matter at high linear speeds (>100 m/s);
- high corrosion on the water side in the event of sedimentation of deposits and/or stagnating/dead zones given that the secondary circuit is a natural radiator (secondary circuit for near-saturated medium-high pressure water);
- risk of local overheating in the aforementioned depressed flow zones owing to the collapse of the boiling coefficient of the saturated water;
- concentration of bubbles in the top part of the exchanger with potential further stagnation/blanketing and associated overheating.

The main object of the present invention is to overcome the problems of the prior art by providing junctions with an improved structure for joining the double-walled tubes in heat exchangers. Furthermore, a further object is to provide heat exchangers with such junctions. In view of these objects the idea which has occurred is to provide, according to the invention, an end junction of a double-walled tube in a heat exchanger, the double-walled tube comprising an inner tube in which a fluid to be cooled flows and an outer tube which defines with the inner tube a cavity in the double-walled tube in which a cooling fluid flows, characterized in that it comprises at one end of the double-walled tube an end plate in which there is a seat having an opening on one face of the end plate, an end portion of the end of the inner tube being housed coaxially in the seat through said opening, and with the corresponding outer tube which is peripherally fixed sealingly around said opening, a deflector extending the inner wall of the outer tube inside the seat so as to define a toroidal cavity between the deflector and a side wall of the seat, the seat being closed by a bottom which is opposite to said opening and which has a passage connected sealingly to the end of the inner tube in the seat for the transit of the fluid to be cooled, a radial space being present near the said bottom between the toroidal cavity and the inner cavity of the double-walled tube, and the end plate having at least one conduit which emerges inside the toroidal cavity for the inflow or the outflow of the cooling fluid.

Still in view of these objects, another idea which has occurred is to provide, according to the invention, a heat exchanger comprising a bundle of double-walled tubes each formed by an inner tube and by an outer tube, with flowing of fluid to be cooled inside the inner tube and flowing of cooling fluid inside a cavity between inner tube and outer tube, with an inlet for the fluid to be cooled at one end of the bundle of double-walled tubes and an outlet for the fluid to be cooled which is cooled at the other end of the bundle of double-walled tubes, and with manifolds for the cooling fluid at the two ends of the double-walled tube bundle, connected to the said cavities between inner tubes and outer tubes, characterized in that at least at one end of the tube bundle the connection between each tube of the bundle, corresponding inlets or outlets for the fluid to be cooled and manifolds for the cooling fluid is realized with a junction of the aforementioned type.

In order to illustrate more clearly the innovative principles of the present invention and its advantages compared to the prior art, an example of embodiment applying these principles will be described below with the aid of the accompanying drawings. In the drawings.

Figure 1:
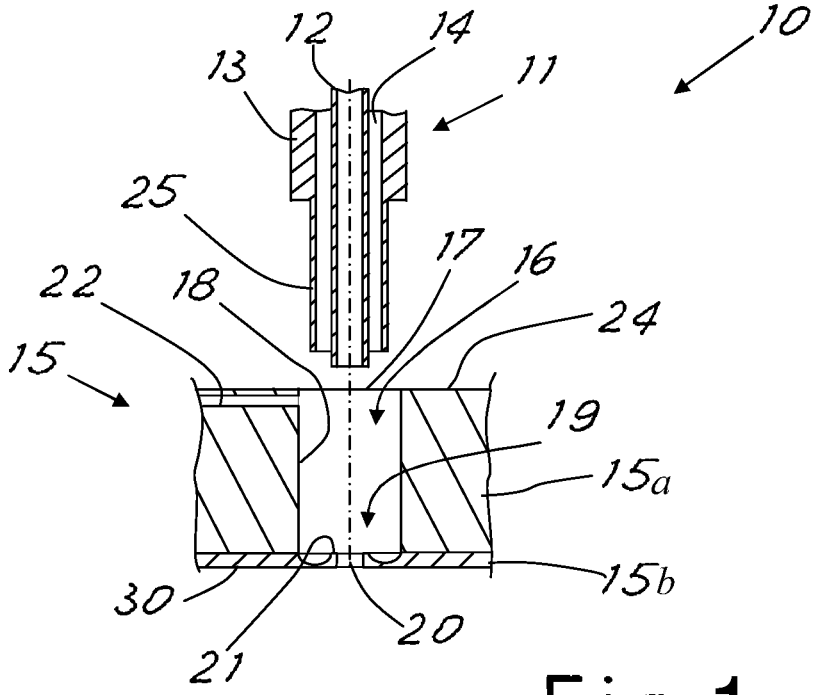
FIG. 1 shows a partially sectioned, exploded, schematic side view of a first embodiment of a junction according to the invention.
Figure 2:
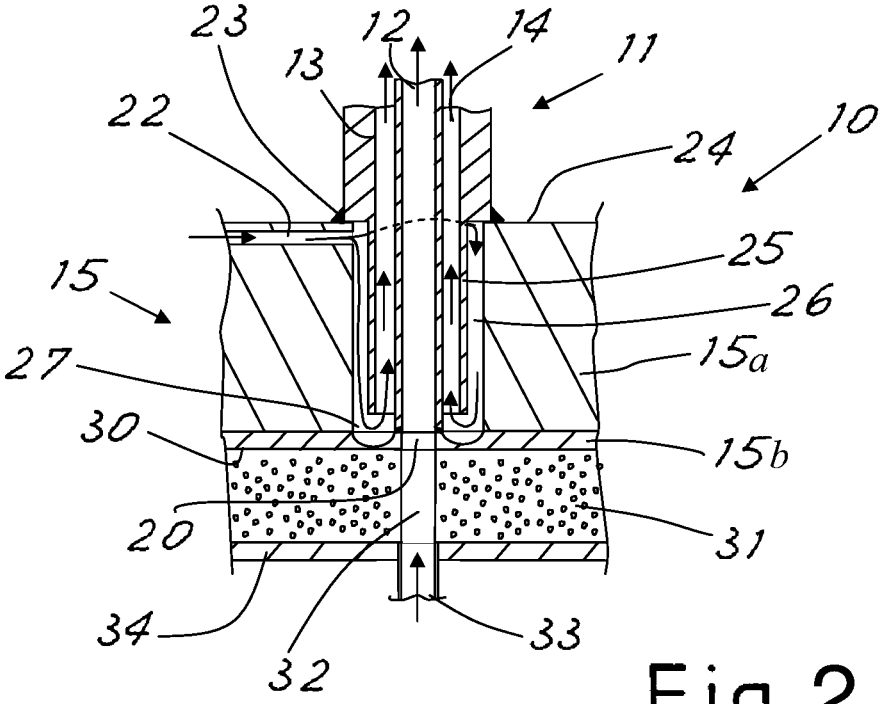
FIG. 2 shows a schematic assembled view of the junction according to FIG. 1.

With reference to the figures, FIGS. 1 and 2 show, respectively, an exploded view and assembled view of an end junction, denoted overall by 10, of a double-walled tube (or double tube) 11 in a heat exchanger.

The double-walled tube 11 comprises an inner tube 12 inside which a fluid to be cooled flows and an outer tube 13 which is coaxial with the inner tube and defines with the inner tube a cavity 14 inside which the cooling fluid (for example water) of the exchanger flows.

The junction comprises an end plate 15 in which there is a seat 16 which has an opening 17 on one face 24 of the plate directed towards the double-walled tube.

The seat 16 has a side wall 18 (which may advantageously have a cylindrical form coaxial with the double tube 11) and a bottom 19 opposite to the opening 17 and therefore facing the end of the double tube 11.

The bottom 19 has a passage 20 which is coaxial with the tube and which is sealingly connected to the end of the inner tube 12 for the transit of the fluid to be cooled. Advantageously the connection is obtained by means of welding. Preferably, the passage 20 has a collar 21 which projects into the seat 16 so as to be coaxial with the inner tube 12 and allow butt-welding of the end of the inner tube. Said welding may be of the IBW type, i.e. an internal bore welding, as may be easily imagined by the person skilled in the art.

The end plate 15 also has at least one conduit 22 which emerges in the side wall 18 for the inflow or outflow of the cooling fluid, as will be explained below. This conduit emerges inside the seat 16 in a position advantageously close to the opening 17 so as to obtain a circulation of the cooling fluid over the entire height of the seat, as will be explained below. As can be clearly seen in FIG. 2, the opening 17 of the seat 16 houses coaxially inside the seat an end portion of the end of the inner tube 12 which extends preferably by a certain amount beyond the end of the outer tube. The corresponding outer tube 13 is peripherally connected sealingly around the opening 17. Advantageously, the opening 17 follows the perimeter of the outer tube 13 and has a diameter which is smaller than the outer diameter of the outer tube so as to allow the formation of a peripheral weld 23.

Advantageously, the diameter of the opening 17 has a value between the outer diameter and the inner diameter of the outer tube 13. In this way the inner wall of the outer tube projects into the opening 17 and far from the side wall 18 of the seat.

A deflector 25 extends the inner wall of the outer tube 13 inside the seat 16 so as to define a substantially toroidal cavity 26 between the deflector 25 and the side wall 18 of the seat. The circulation conduit 22 thus leads into this cavity. Advantageously the conduit 22 emerges inside the toroidal cavity in a direction radial thereto.

As will be explained below, the conduits 22 which emerge inside the toroidal cavity may be more than one and are arranged preferably at intervals around the toroidal cavity so as to ensure a sufficiently uniform distribution of the cooling fluid.

A radial space 27 is also present close to the bottom 19 between the cavity 26 and the cavity 14 inside the double-walled tube and connects the two cavities. This radial space may be simply obtained by designing the deflector with dimensions so as to have the end edge which remains far from the bottom 19. Advantageously the bottom 19 may also be shaped so as to connect with a curved section the side wall 18 of the seat and the wall of the inner tube welded to the passage 20, as can be seen for example in the figures.

The distance of the end of the conveyor from the bottom of the seat may be for example of the order of centimetres, but sufficient to allow a circular symmetrical inflow of the cooling fluid into the annular portion between the inner tube and the inner diameter of the conveyor. For example, this distance may be about 5-20 mm and is preferably about 10-15 mm.

As can be seen in FIGS. 1 and 2, the deflector 25 may be made with a final portion of the outer tube 13 having a reduced external diameter so as to enter into the seat through the opening 17 and face the side wall 18 of the seat.

Alternatively, the deflector may be made with a cylindrical collar 25*b* which projects into the seat from the opening 17. In this case, as can be seen for example in FIG. 3, the collar 25*b* may project into the seat from a cover 28 placed on top of the face 24 of the plate. The cover 28 may also advantageously comprise a collar 29 which projects with respect to the plane of the cover 28 so as to allow butt-welding of the outer tube 13. The cover 28 may have a very small thickness compared to the plate 15. For example, the cover 28 may have a thickness which is between 1/80th and 1/60th of the plate 15. In particular, the cover 28 may have a thickness in the region of 10-15 mm.

Advantageously, the radial width of the cavity 26 is such that, with respect to the radial amplitude of the cavity 14 inside the double tube, a high falling speed suitable for ensuring a uniform flow in every angular position is created inside the chamber for downward vertical distribution of the cooling fluid. For example, the amplitude of the cavity 26 may be substantially the same as, if not smaller than the amplitude of the cavity 14.

The deflector 25 may have a smaller thickness (for example about 1.5-2 mm), not being subject to particular stresses since it is of the differential pressure type.

As can be clearly seen in the figures, the end plate 15 may be advantageously formed by a first plate 15*a* and by a second plate 15*b* which are coupled together. The two plates 15*a* and 15*b* may be advantageously made so that the side wall 18 of the seat 16 is situated substantially in the first plate and the bottom 19 of the seat is situated in the second plate.

This simplifies even more the formation of the seat, which is formed for example by a simple cylindrical through-hole, and of the bottom, which may be shaped.

The plate 15 (or the first plate 15*a*) may have advantageously a thickness at least equal to 500 mm (at least when used on the inlet side for the fluid to be cooled) so as to form a suitable height of the seat and make the assembly very robust. Preferably, the plate 15 (or 15*a*) on the inlet side of an exchanger may have a height of at least 750 mm. The plate 15*b*, if present, may instead be much thinner. For example it may be between 1/80th and 1/60th of the plate 15*a*. In particular, it may be for example 10-15 mm thick.

The plate 15 (or 15*a*) may be advantageously a solid plate.

The large thickness of the plate 15 advantageously strengthens the connections at the ends of the tubes which are subject to varying degrees of elongation due to thermal expansion.

The two plates may be coupled together using various known methods. For example they may be welded together.

The plate 15 (and in the case of two plates 15*a*, 15*b*, at least the plate 15*a* which forms the face 24 towards the tubes) may be advantageously made as a forged piece. Using a forged piece is advantageous because it has a load limit higher than that of the tubes. Moreover, preferably said plate is made of highly yielding steel (Mn—Mo—Ni)

The use of a highly yielding material such as Mn—Mo—Ni is also advantageous because it has a greater elongation (for the same operating temperature) than carbon steel, from which the outer tubes may be advantageously made. Since the inner tubes are hotter than the outer tubes, it follows that by making this part using high-quality metals, it is possible to reduce/lessen the (compressive) axial force of the inner tubes.

Figure 3:
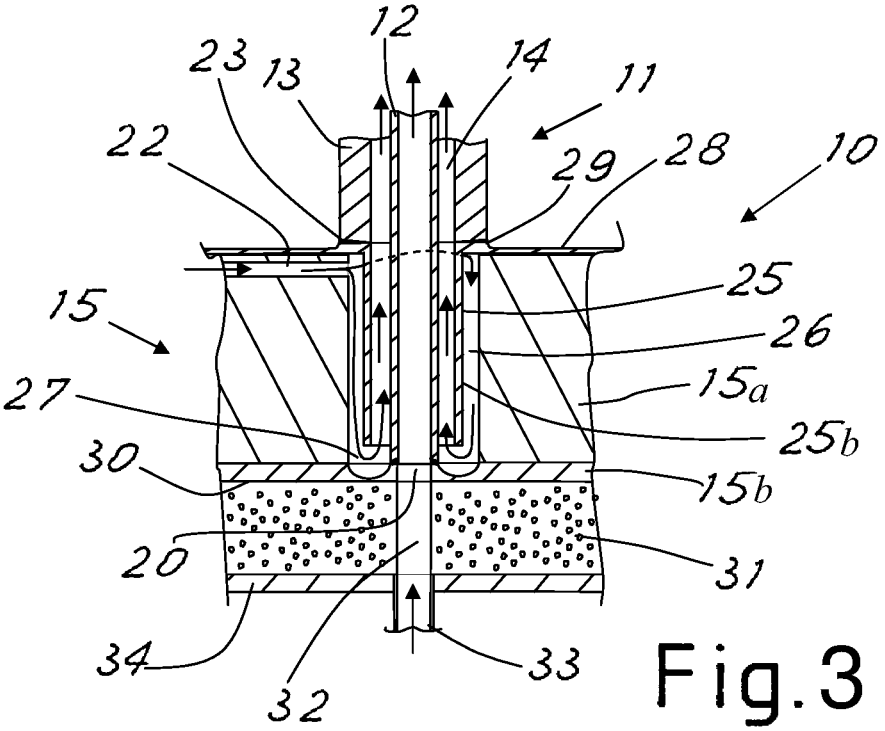
FIGS. 3, 4 and 5 show partially sectioned, schematic side views of a second, third and fourth embodiment, respectively, of a junction according to the invention.

As can be seen again in FIGS. 2 and 3, the passage 20 opens out advantageously in a face 30 of the end plate 15 which is opposite to the double-walled tube. The two faces 24 and 30 may be parallel to each other and extend transversely with respect to the axis of the double-walled tubes. A layer of refractory material 31 may be present on the face 30. This layer of refractory material is crossed by an extension 32 of the passage 20 so as to allow the transit of the fluid to be cooled through the layer 31.

A tube 33 may convey the fluid to be cooled to the passage 20/32.

The passage 20, the extension 32 and the tube 33, if present, are all advantageously coaxial with the inner tube 12 so as to create a minimum obstacle to the passage of the fluid flow inside the inner tube 12.

The tube 33 may also project from a tube plate 34 applied onto the free face of the refractory material. In this way, the heat at the outer end of the tube 33 is at least partially conveyed to the plate 34 which is thermally insulated from the face 30 of the plate 15 owing to the layer of refractory material 31.

Figure 4:
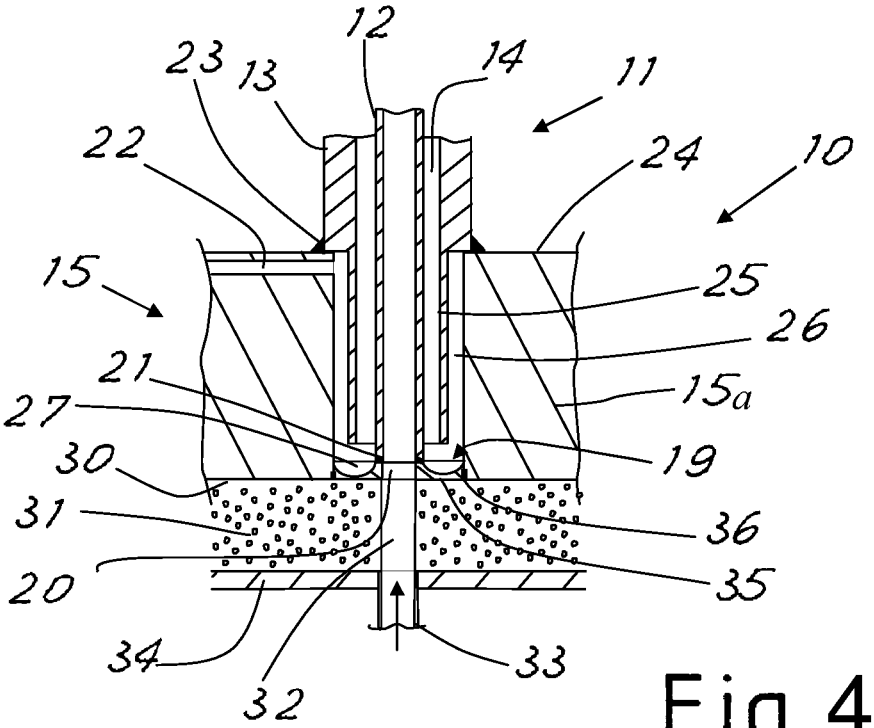

FIG. 4 shows in schematic form a variation of embodiment of the junction 10, in which the bottom of the seat 19 is formed with a sealing plug 35 inserted into the seat 16 and welded peripherally at 36 to the edge thereof opposite to the opening 17. This allows for example advantageously the plug 35 to be welded to the end of the inner tube 12 before inserting the whole assembly inside the seat 16 and then welding the plug to the seat once the tube with the plug have been inserted in position inside the seat. In this embodiment also, there may be provided a refractory layer 31 placed against the plate 15*a* and a tube plate 34*a* from which there projects a tube 33 for arrival of the fluid to be cooled, which is aligned with the passage 20 and the extension 32 inside the refractory layer, as described above for the embodiments shown in FIGS. 2 and 3.

Figure 5:
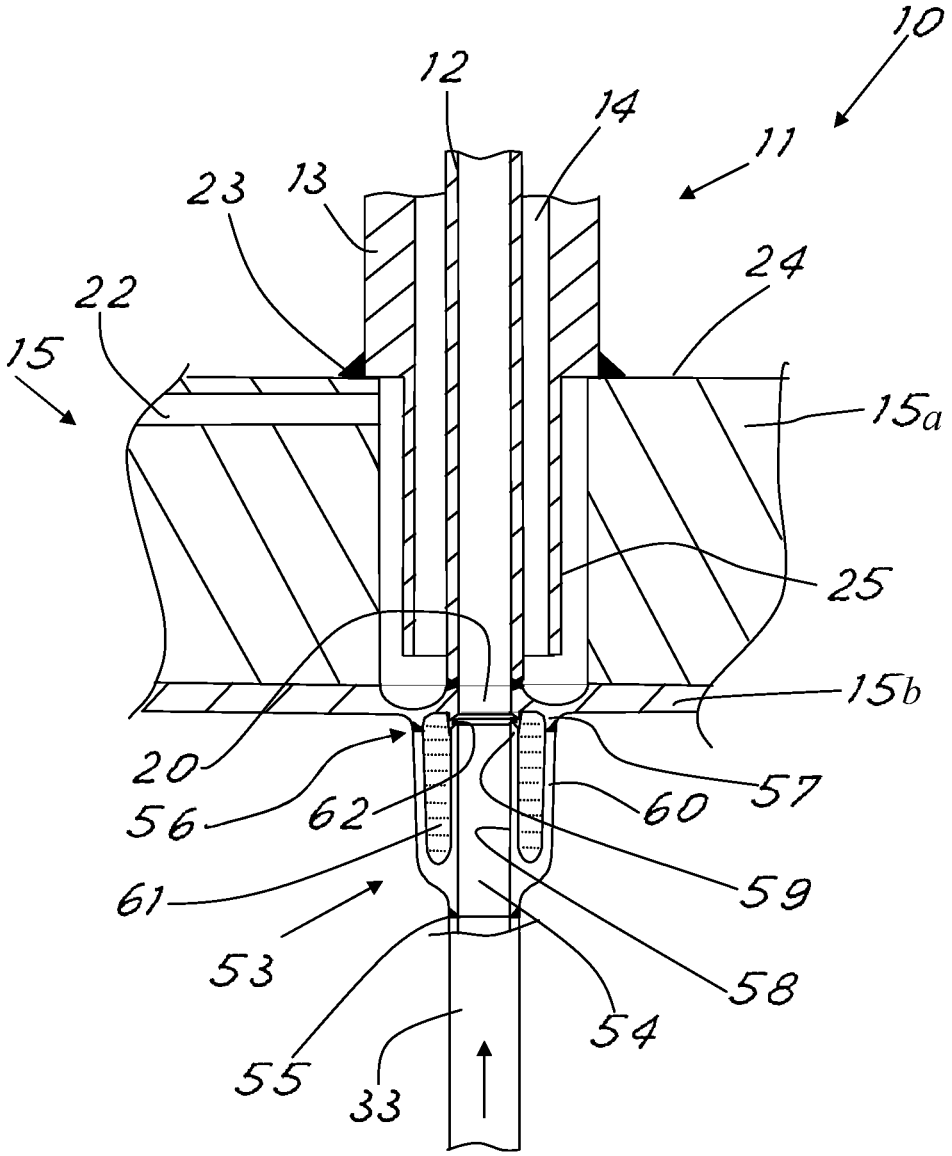

FIG. 5 shows a possible variation of embodiment of the junction 10. In this variant, a connecting element 53 is used instead of the layer of refractory material. This element 53 is arranged between the plate 15 (or 15*b*) and the tube 33 for arrival of the fluid to be cooled and connects the inside of the tube 33 to the passage 20 by means of an associated tubular inner passage 54.

As can be clearly seen in FIG. 5, the element 53 has a form with a generally Y-shaped section so as to define a single-walled first end 55 and an opposite double-walled second end 56. The single-wall end is welded to the tube 33, while the outer part of the double-walled end 56 is welded to the plate 15. The plate 15 may have in the region of the weld a collar 57 around the passage 20 for facilitating butt-welding, to the plate, of the outer part of the element 53.

The inner wall 58 of the tubular passage 54 has an end 50 close to the passage 20 which is free to define an annular space which allows the axial movement of this end 50 so as to compensate for the thermal expansions produced by the hot fluid which flows inside the passage 54. The inner wall 58 and the outer wall 60 of the double-walled part of the element 53 define a cavity which is filled with thermally insulating material 61 in order to reduce the passage of heat towards the outer wall 60. The thermally insulating material 61 may be preferably multi-layered with a variable conductivity (higher up towards the tube 33) and optionally in several circumferential sectors, namely with circumferential interruptions. This may avoid the formation of cracks.

Advantageously the annular space at the end 59 of the inner wall 58 may be at least partially closed by a suitable seal 62 so as to reduce at least the possible infiltrations between the passage 54 and the cavity filled with insulating material 61.

The seal 62 may be advantageously made with a split metal ring so as to allow its compression between the end 59 and the facing edge of the passage 20 when the end 59 moves close to this edge following thermal expansion of the wall 58. In order to facilitate this movement, the end 59 and the facing edge of the passage 20 may be preferably made inclined with respect to the axial direction of the passage 54.

Although described for sake of simplicity in relation to the connection shown in FIG. 2, it is understood that the element 53 may be obviously used also in the other embodiments of a connection according to the present invention.

Figure 6:
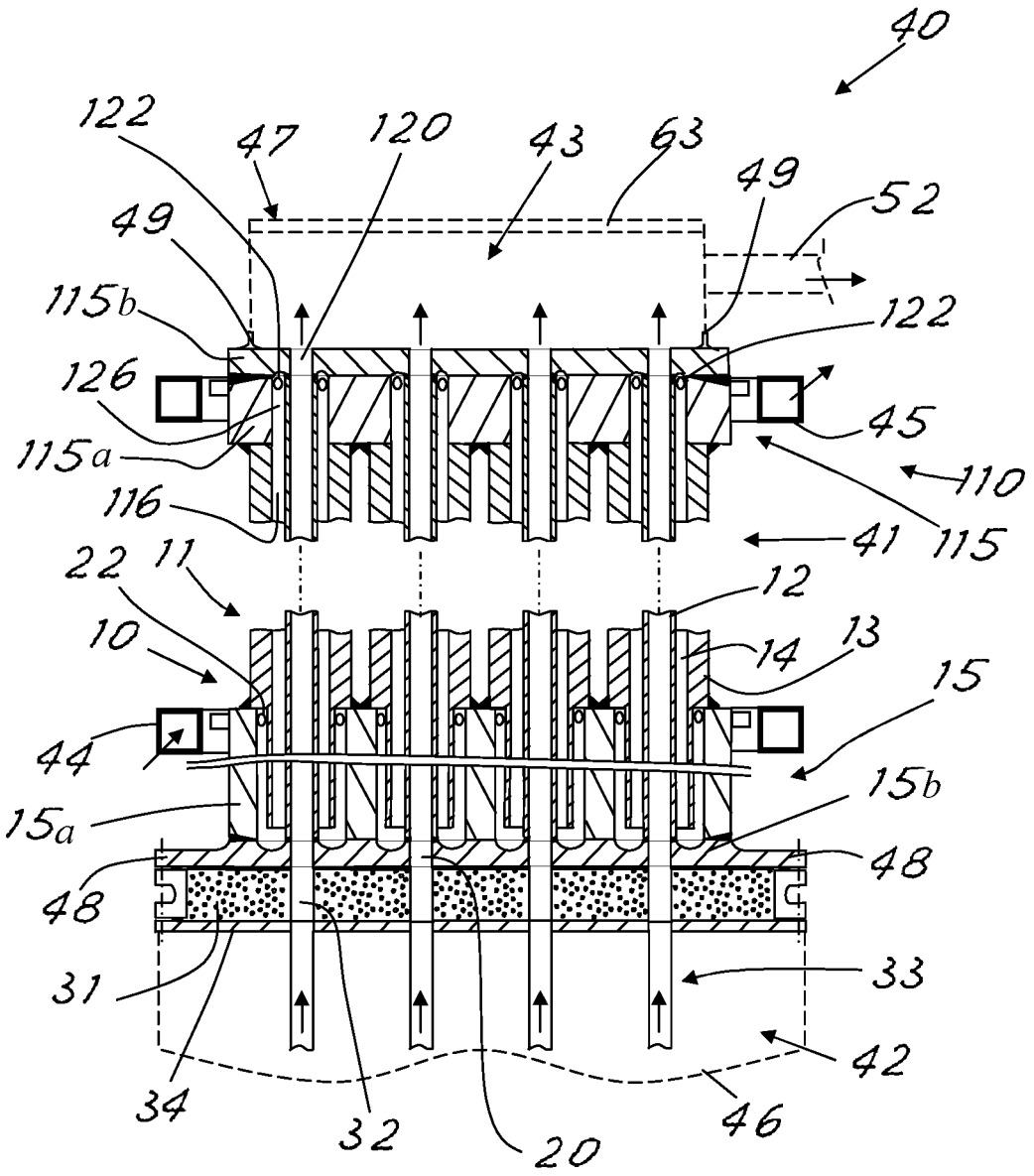
FIG. 6 shows a partially sectioned, partial, schematic side view of an exchanger according to the invention.

FIG. 6 shows schematically a cross-section of a heat exchanger with double-walled tubes, denoted generally by 40, provided according to the invention.

This heat exchanger 40 comprises a bundle 41 of double-walled tubes, each formed by an inner tube 12 and an outer tube 13. The fluid to be cooled flows inside the inner tubes 12, while the cooling fluid flows inside the cavity 14 between the inner tube and outer tube.

The inflow of the fluid to be cooled occurs at one end 42 of the tube bundle and the outflow of the cooled fluid occurs at the other end 43 of the tube bundle. Manifolds 44 and 45 for the cooling fluid are also present at the two ends of the tube bundle and are connected to the cavities 14 of the tubes so as to allow the cooling fluid to flow inside said cavities.

For simpler description reference will be made to an exchanger with inflow of the fluid to be cooled from the bottom and a flow of cooling fluid which is co-current, namely also from the bottom upwards. This is the configuration which covers almost all the existing plants. For the person skilled in the art it however may be easily understood that the exchanger may be designed also with different configurations (for example, fluid to be cooled from the top and cooling fluid from the bottom in a counter-current arrangement).

In particular, the fluid to be cooled may consist of the fumes output from an ethylene oven and the cooling fluid may be saturated water at a suitable pressure.

At at least one end of the tube bundle, the connection between each tube of the bundle, the corresponding inlets or outlets for the fluid to be cooled and the manifolds for the cooling fluid is performed with a junction 10 according to the invention. For example, FIG. 6 shows an exchanger with junctions 10 advantageously used on the inlet side of the exchanger (the bottom side in FIG. 4) where the plate 15 (preferably divided into a first plate 15*a* and a second plate 15*b*) with the seats 16, the bottom 19 and the deflector 25 is therefore present.

For simpler illustration, FIG. 6 shows by way of example junctions of the type shown in FIG. 2, but it is understood that different connections according to the invention may also be used (for example those shown in FIG. 3 or 4), as may now be easily imagined by the person skilled in the art.

Preferably, the end plates 15 of the junctions 10 of several adjacent double-walled tubes (or, if present, the first and/or the second plate of the end plates of the junction 10 of several adjacent double-walled tubes) are made as a single piece.

In other words a single plate 15 (or 15*a* and/or 15*b*) extends between several tubes of the exchanger and has all the seats 16 for these tubes, as can be clearly seen in FIG. 4.

This single plate (preferably the plate 15 or the plate 15*a*) may be advantageously forged as a single solid block, with the thicknesses already mentioned above. The second plate 15*b*, where present, may also be forged or obtained from a shaped metal sheet.

The plates 15*a* and 15*b* may be connected together by means of welding, so as to ensure sealing of the cooling fluid with respect to the exterior.

Underneath the single plate there may be present (typically only on the inlet side for the fluid to be cooled) the layer 31 of refractory material and optional tube plate 34 and the tubes 33 for arrival of the fluid to be cooled. The inner tubes thus receive directly the fluid to be cooled which passes through the extensions 32 present inside the refractory material.

The plate 15 with the optional layer of refractory material and optional tube plate 34 thus forms a plate similar to the tube plate of an exchanger with tube bundle and container under pressure. In this way, the exchanger according to the invention may be easily connected to a chamber 46 for arrival of the fluid to be cooled through the tubes 33, which are for example connected to the outlet of an ethylene oven.

The chamber 46 in reality does not exist because the hot fumes are conveyed to the outlet of the oven, already inside the tubes 33.

On the outlet side (top side in FIG. 6) of the exchanger according to the invention the structure of the junction 10 may be advantageously replicated, preferably with some advantageous modifications.

For simpler illustration, elements of the outlet junction similar to those of the inlet junction are indicated in the figures by the same numbers, increased by 100.

As can be seen in FIG. 6, the top junction of each tube (denoted generally by 110) is advantageously formed with an outlet end plate 115 in which a seat 116 for each tube is formed. Unlike the inlet junction 10, in the outlet junction 110 the deflector 25 is preferably not present and the end of the outer tube 13 is peripherally fixed sealingly onto the outlet end plate 115 for connection to said seat 116 so as to define a cavity 126 which is an extension, inside the seat 116, of the cavity 14 of the double-walled tube around the outlet end of the inner tube 12. The inner tube 12 is connected to an outlet passage 120 on the bottom of the seat 116 so that the cooling fluid circulating in the seat surrounds the end of the inner tube inside the seat.

Advantageously, the end of the outer tube is butt-welded onto the plate 115 so that the inner wall of the outer tube is situated substantially flush with the side wall of the seat 116 (thus formed with a diameter substantially the same as the internal diameter of the outer tube 13). In the outlet end plate 115 there is at least one conduit 122 which emerges inside the cavity 126 for the passage of the cooling fluid which flows inside the cavity 14 of the double-walled tube 11. The passage for the cooling fluid 122 is advantageously formed close to the bottom of the seat 116 instead of being close to the opening of the seat which acts as an inlet for the double tubes, as it is instead for the inlet side of the exchanger.

This makes it possible to avoid downward vertical movements of the cooling fluid inside the seat and prevents any vapour bubbles, which could form at the top end of the exchanger, from hindering the outflow of the cooling fluid through the passages 122.

The top plate 115 or 115*b* will be comparable to the cold tube plate of a shell-and-tube exchanger and may be connected to a chamber 47 for collecting the fluid from the inner tubes 12 for evacuation thereof (for example via a conduit 52), as may be now easily imagined by the person skilled in the art.

The plate 115 (or 115*a*) at the top end of the tubes may also have a thickness smaller than the thickness of the corresponding plate at the bottom end of the tubes, in order to prevent downward vertical movements of the cooling fluid which in this top zone may be for example a two-phase mixture of water+steam.

For example the top plate (which is again advantageously forged and made of Mn—Mo—Ni material) may have a thickness equal to about a third of the thickness of the bottom plate. In particular, the top plate may have a thickness for example of about 250 mm.

Moreover, the junctions on the cold side generally do not require a refractory layer as instead preferable for the junctions on the hot side.

Apart from the modifications mentioned here, the top junctions 110 may in any case be similar to that already described for the junction 10.

Figure 7:
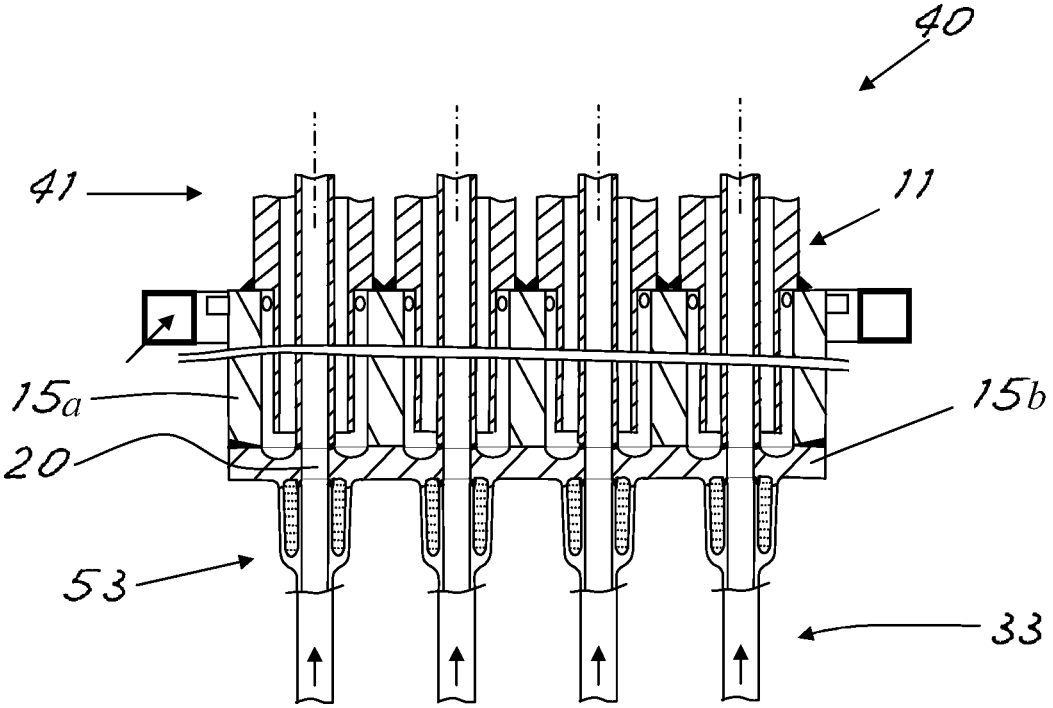
FIG. 7 shows a partially sectioned, partial, schematic side view of a possible variation of embodiment of the exchanger according to FIG. 5.

FIG. 7 shows a variant of the junctions 10 on the hot side of an exchanger 40, again within the context of the present invention. In this variant the layer of refractory material has been replaced by the connecting elements 53, so as to obtain essentially junctions 10 of the type described with reference to FIG. 5. All the tubes 33 are thus connected to the respective passages 20 by means of the elements 53.

In an exchanger according to the invention, the arrangement of the plurality of double tubes grouped together by a single plate may be different depending on the specific practical requirements, and may also use any of the junctions according to the invention.

Figure 8:
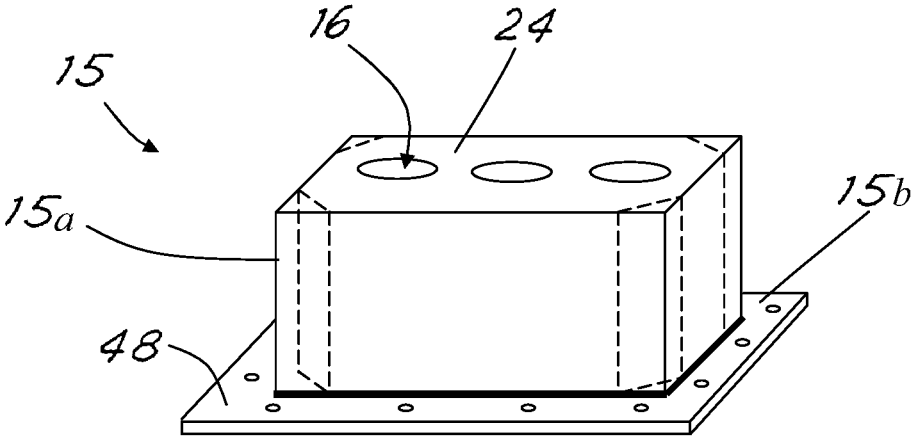
FIG. 8 shows a schematic perspective view of a possible plate of the junction according to the invention.

FIG. 8 shows in schematic form a perspective view of a possible plate 15 advantageously formed by a forged thick plate 15*a* and by a thin plate 15*b* which also forms possible lateral fixing flanges 48. This plate has a plurality of seats 16 which emerge on the surface 24 of the plate in order to house corresponding double-walled plates and form an exchanger according to the invention.

The plate may be shaped in the manner of a parallelepiped with a rectangular base or have chamfered lateral corner edges (as shown in broken lines again in FIG. 8) or may also have a rounded side wall so as to follow at least partially the progression of the side walls of the seats 16. For example, this is shown in FIGS. 9 and 10.

Figure 9:
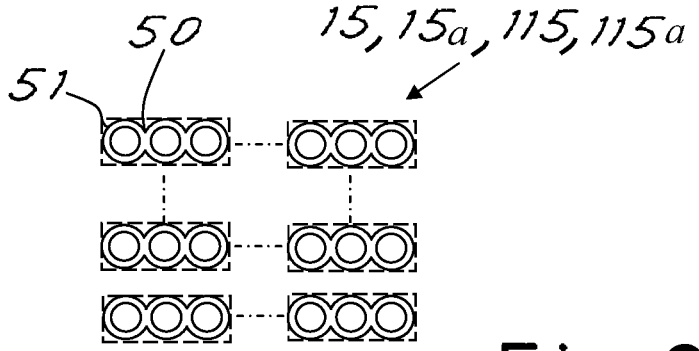
FIGS. 9 and 10 show partial schematic plan views of possible connection plates present at the end of tubes of an exchanger according to the invention.

It is possible to consider forming plates 15 (or 15*a*) with a certain number N of adjacent aligned seats (for example 3 seats) so as to thus form modular structures of N double-walled tubes which may be arranged alongside each other in one or two directions, as shown schematically for example in FIG. 9, in order to form exchangers with any number of double tubes.

Figure 10:
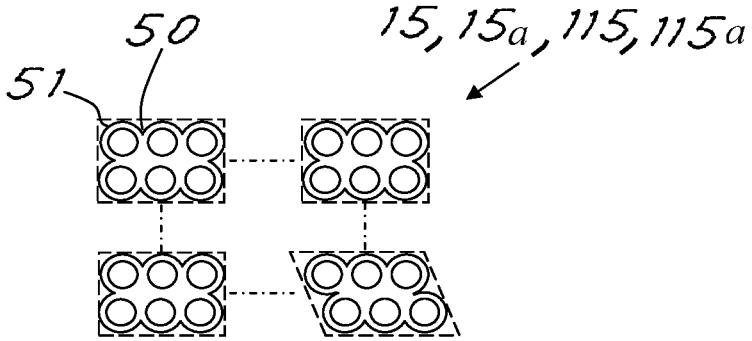

It is also possible to consider forming plates 15 (or 15*a*) with M rows (for example two rows) of N adjacent aligned seats (for example 3 seats) so as to thus form modular structures of N×M tubes which may be arranged alongside each other in one or two directions, as shown schematically for example in FIG. 10.

In any case, as mentioned above, the plate 15 or 15*a* made as a single piece for several tubes may have a peripheral edge 51 which is varyingly shaped and which for example follows at least partially the progression of the side wall of the seats on the edges of the plate so as to obtain a suitable wall thickness of the seats, as can be seen in FIGS. 9 and 10.

It is thus possible to obtain plates with angled points 50 which allow all the double tubes to be joined together and provide the system with a rigid structure.

The plates 15*b*, where present, may also be formed so as to follow at least approximately the contour of the plates 15*a* to which they are joined. These plates 15*b* may have peripherally lateral flanges (for example shown at the two ends and indicated by 48 in FIG. 6) in order to bolt together sealingly the inlet of the exchanger, or of the modules which form it, to the chamber 46 for arrival of the fluid to be cooled.

The top plate 15*b* may also comprise end lugs 49 for the welded connection of the chamber 47. The chamber 47 may be advantageously oval/ellipsoidal and may advantageously combine the cooled fluid output from all the inner tubes. The chamber may also be able to be inspected by means of a suitable closing cover 63, shown in broken lines in FIG. 6. This cover may be a flat ellipsoidal cover facing the outlet passages 120.

The inlet conduits 22 (bottom side) and outlet conduits 122 (top side) for the cooling fluid may be connected to the respective manifolds 44 and 45 connected in turn to a known cooling fluid treatment and circulation circuit. The manifolds 44 and/or 45 may be for example made so as to comprise a distribution toroid which laterally surrounds at least some junctions and from which the conduits which emerge inside the cavities of the junctions extend.

Figure 11:
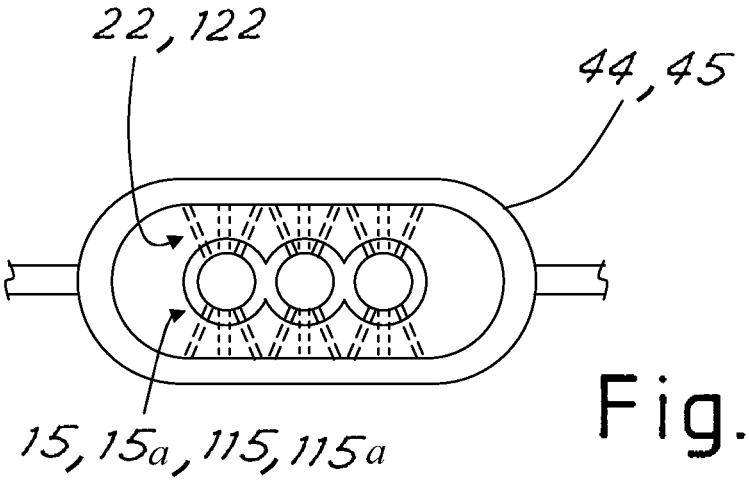
FIG. 11 shows a partial schematic plan view of possible connections for the cooling fluid at the end of tubes of an exchanger according to the invention.

For example, FIG. 11 shows schematically a plan view of a plate of a three-tube module which has conduits for the cooling fluid which extend radially towards a toroidal manifold 44 or 45 which surrounds the module.

If desired, the double tubes in the exchanger may also be arranged alongside each in several parallel planes, with the tubes in each plane which are staggered for example by half a step with respect to the tubes in the adjacent planes. This is shown schematically by way of example for the module at the bottom on the right in FIG. 10.

Preferably, the inlets for the cooling fluid, in particular water, are close to the top of the seat 16 of the tubes, as already described above, and are advantageously at least two in number for each double tube and, for example, are all connected for each module to a toroid supplied by the downward tube(s) from a known steam generator (not shown).

The outlets for the water+steam mixture from the seats 116 in the top part of the exchanger are multiple, are as close as possible to the top of the seat and may also be as numerous as possible around the circumference of each double-walled tube. All the outlets may be connected to the toroid 45 which in turn supplies one or more riser tubes connected to the steam generator (not shown).

Preferably, the inlet manifold 44 may have for example two radially opposite inlets for each double-walled tube (as shown by means of short-dash lines in FIG. 11), while the outlet manifold 45 may have for example four outlets for each double-walled tube (as shown by means of long-dash lines in FIG. 11).

Figure 12:
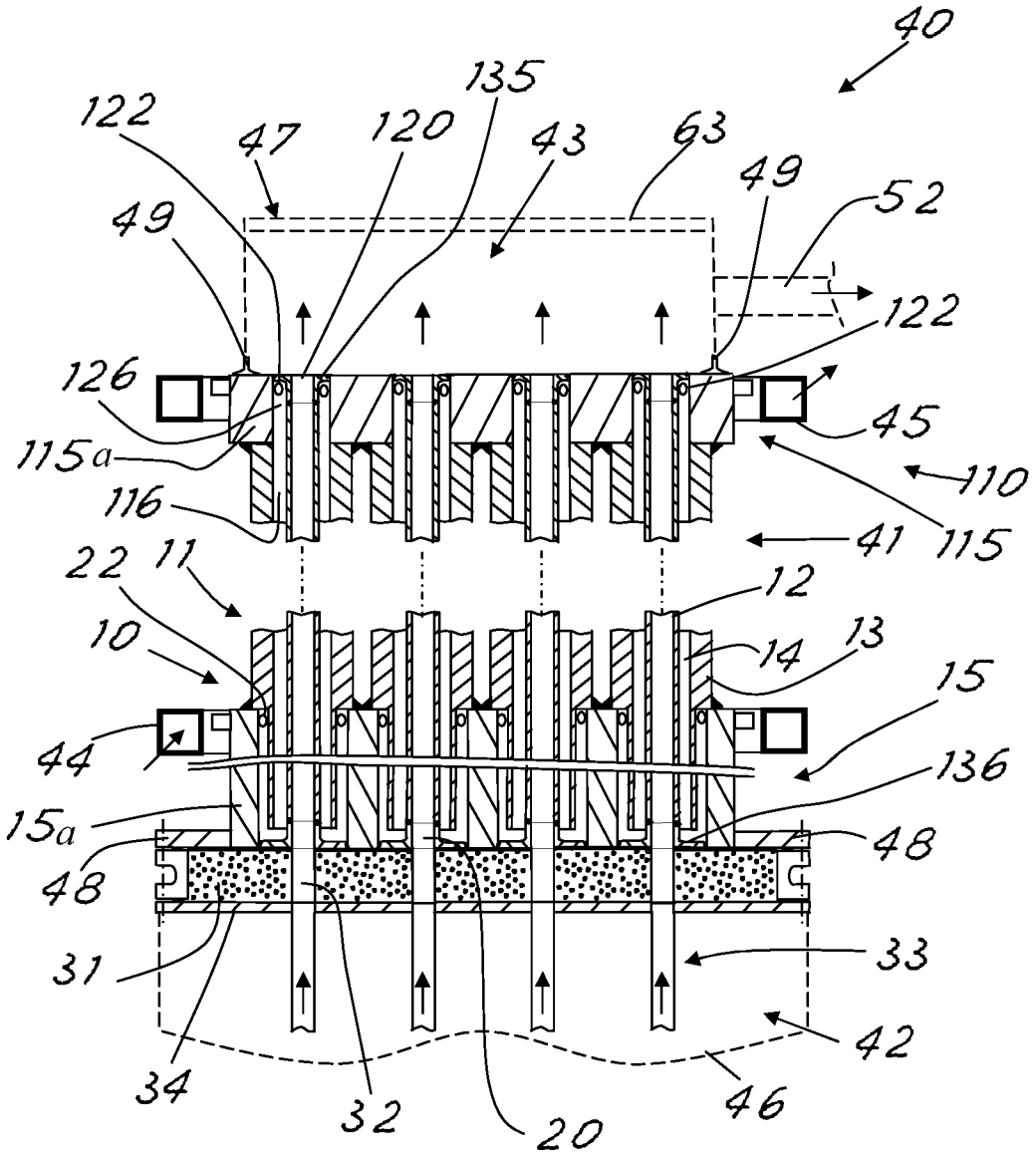
FIG. 12 shows a view similar to that of FIG. 6 of a further constructional variant of an exchanger according to the invention.

FIG. 12 shows a constructional variant of an exchanger according to the invention which uses junctions with sealing plugs similar to those schematically shown in FIG. 4.

Elements similar to those shown in FIG. 6 are indicated in FIG. 12 using the same numbers, unless otherwise indicated, and are not further described in detail below.

At the two ends of the inner tubes the exchanger 40 according to FIG. 12 comprises respective sealing plugs 135 and 136. The plug 135 is welded in position on the plate 115*a*, while the plug 136 is welded in position on the plate 15*a*. In this way the plates 115*b* and 15*b* are not required. The flanges 48 may be made for example in the form a surrounding rim welded to the plate 15*a*.

Advantageously, the sealing plug at one end (in FIG. 12 the bottom plug 136) has a diameter the same as the diameter of the holes in the plate 15*a* and advantageously at the other end the sealing plug (top plug 135 in the figure) has a diameter which is substantially the same as the internal diameter of the outer tube. In this way, the sealing plugs may be welded onto the inner tubes before the inner tubes are inserted inside the outer tubes. It is thus possible first to fix the outer tubes between the respective plates and then insert the inner tubes (from the end with the smaller-diameter sealing plug) and weld them in position. This simplifies greatly the assembly of the exchanger and reduces the time needed for construction thereof.

At this point it is clear how the predefined objects have been achieved.

The junction and the exchanger proposed solve for example the physiological problems associated with the quenching of hot fumes in heat exchangers of the type comprising banks of double tubes for use, for example, in ethylene ovens.

Moreover, as a result of the junction according to the invention it is possible to obtain a cooling fluid flow with a perfect circular symmetry.

The exchanger according to the invention may also replace advantageously shell-and-tube exchangers.

With the special part formed by the plate 15-115 (15*a*-115*a*) preferably made of highly yielding material (Mn—Mo—Ni steel) and with a high linear expansion coefficient compared to conventional carbon steels it is possible to compensate also for the difference in temperature which exists physiologically between the inner tube and outer tube, reducing the mechanical stresses in the structure.

Use of the plates 15-115, 15*a*-115*a* is able to reduce greatly the compressive axial stress which is exerted on each inner tube.

Moreover, owing to the invention, it is possible to group together the single double-walled tubes into modules so as to create a pseudo-linear shell exchanger (the bottom and top shells being the plates 15 or 15*a* and 115 or 115*a*) which can be more easily supported and moved and transported.

The special geometry which may be realized according to the invention allows the creation for each module of a pseudo-linear exchanger; such that the bottom part and the top part which form the barrier element between the hot fumes and the cooling fluid may be comparable to a pseudo flat tube plate which may also have a flanged extension. The pseudo bottom plate 15*b* may be preferably made of Inconel. The plate 34 and/or the tube 33 may be made of Incoloy. The pseudo top plate, depending on the output temperatures of the fumes, may be made of low alloyed or stainless steel.

The plates 15 or 15*a* and/or the plate 115 or 115*a* are advantageously made of material which is highly yielding and has a specific elongation compared to the tubes in order to lessen the compressive stressing of the tubes.

As described above, the hot fumes output may be conveyed into an ellipsoidal chamber, in view of the low pressure of the cracking fumes, where the outlets of the inner tubes of each module may be connected together. The ellipsoidal chamber may for example in turn terminate in a flanged elliptical cover which may be easily removed and which allows easy inspection/maintenance/cleaning.

Entry of the hot fumes may in turn occur into a chamber which is common to all the inner tubes of each module and which is flanged together with the pseudo bottom tube plate and a plate for example made of Incoloy and in turn welded to the oven outlet openings. This chamber may be suitably protected by refractory material with pre-shaped blocks of material able to withstand erosion/abrasion of the hot fumes.

Obviously, the above description of an embodiment applying the innovative principles of the present invention is provided by way of example of these innovative principles and must therefore not be regarded as limiting the scope of the rights claimed herein. For example, the proportions of the various parts of the junction and the exchanger may vary from that shown in the drawings so as to be adapted to specific requirements, as may be easily imagined by the person skilled in the art. Also the number of tubes and their arrangement may vary depending on the practical implementation and the specific requirements. As mentioned above, the various junctions described and the assembly solutions may be combined in different ways with each other and, where necessary also with the elements 53 in an exchanger according to the invention.

The invention claimed is:

1. End junction of a double-walled tube in a heat exchanger, the double-walled tube comprising an inner tube in which a fluid to be cooled flows and an outer tube which defines with the inner tube a cavity inside the double-walled tube in which a cooling fluid flows, characterized in that it comprises at one end of the double-walled tube an end plate in which there is a seat having an opening on a face of the end plate, an end portion of the end of the inner tube being coaxially housed in the seat through said opening, and with the corresponding outer tube which is peripherally fixed sealingly around said opening, a deflector extending the inner wall of the outer tube inside the seat so as to define a toroidal cavity between the deflector and a side wall of the seat, the seat being closed by a bottom which is opposite to said opening and which has a passage connected sealingly to the end of the inner tube in the seat for the transit of the fluid to be cooled, a radial space being present near the said bottom between the toroidal cavity and the inner cavity of the double-walled tube, and the end plate having at least one conduit emerging inside the toroidal cavity for the inflow or outflow of the cooling fluid.

2. The junction according to claim 1, wherein the side wall of the seat is cylindrical and coaxial with the double-walled tube.

3. The junction according to claim 1, wherein said deflector is made with a final portion of the outer tube having a reduced external diameter.

4. The junction according to claim 1, wherein said deflector is made with a cylindrical collar which projects into the seat from said opening.

5. The junction according to claim 4, wherein the cylindrical collar projects into the seat from a cover placed on top of said face of the plate.

6. The junction according to claim 1, wherein said passage in the bottom has a collar which projects into the seat coaxially with the inner tube and is welded to the end of the inner tube so as to form said sealed connection.

7. The junction according to claim 1, wherein the conduit emerges inside the toroidal cavity in a radial direction.

8. The junction according to claim 1, wherein the conduits which emerge inside the toroidal cavity are more than one and are arranged around the toroidal cavity.

9. The junction according to claim 1, wherein the end plate is formed by a first plate and a second plate coupled together, the side wall of the seat being substantially in the first plate and the bottom of the seat being in the second plate.

10. The junction according to claim 9, wherein at least the first plate is a forged piece, preferably made of a highly yielding material with a high specific elongation.

11. The junction according to claim 1, wherein said passage connected sealingly to the end of the inner tube in the seat opens out on a face of the end plate which is opposite to the double-walled tube and on said face there is a layer of refractory material crossed by an extension of said passage to allow transit of the fluid to be cooled through the refractory material layer.

12. The function according to claim 1, wherein said passage which is connected sealingly to the end of the inner tube in the seat opens out on a face of the end plate which is opposite to the double-walled tube and on said face there is a connecting element for arrival of the fluid to be cooled, with a Y-shaped section for defining a single-walled first end for arrival of the fluid; and an opposite double-walled second end connected to the plate, an inner wall of the connecting element having one end near to the passage which is free to define an annular space, and a cavity filled with material which is thermally insulating, preferably multilayered with variable conductivity and with one or more circumferential interruptions, is defined between an inner wall and an outer wall of the connecting element.

13. The junction according to claim 12, wherein the annular space is at least partially closed by a seal.

14. A heat exchanger comprising a bundle of double-walled tubes each formed by an inner tube and an outer tube, with flowing of fluid to be cooled inside the inner tube and flowing of cooling fluid inside a cavity between inner tube and outer tube, with an inlet for the fluid to be cooled at one end of the bundle of double-walled tubes and an outlet for the fluid to be cooled which is cooled at the other end of the bundle of double-walled tubes, and with manifolds for the cooling fluid at the two ends of the bundle of double-walled tubes, connected to the said cavities between inner tubes and outer tubes, characterized in thatwherein at least at one end of the tube bundle the connection between each tube of the bundle, corresponding inlets or outlets for the fluid to be cooled and manifolds for the cooling fluid is realized with a junction according to claim 1.

15. The exchanger according to claim 14, wherein the end plates of the junction of several side-by-side double-walled tubes, or the first plate and/or the second plate of the end plates of the junctions of several side-by-side double-walled tubes are made as a single piece.

16. The exchanger according to claim 15, wherein said single piece is a forged piece.

17. The exchanger according to claim 15, wherein said single piece has a peripheral edge which at least partially follows the progression of the side wall of said seats in said single piece.

18. The exchanger according to claim 14, wherein the junctions present at one end of the exchanger which is the inlet for the fluid to be cooled have a face of the end plate, opposite to the double-walled tubes, on which face said passages connected sealingly to the end of the inner tube for the inlet flow of the fluid to be cooled open out, on said face there being a layer of refractory material crossed by extensions of said passages so as to allow transit of the fluid to be cooled towards the inner tubes.

19. The exchanger according to claim 14, wherein the cooling fluid manifolds comprise a distribution toroid which laterally surrounds at least some junctions and from which the conduits which emerge inside the toroidal cavities for the inflow or outflow of the cooling fluid from the junction extend.

20. The exchanger according to claim 14, wherein at the end of the exchanger which is the outlet for the fluid to be cooled there are junctions comprising an outlet end plate in which there is a seat housing the outlet end of the inner tube, with the inner tube which is connected to an outlet passage in the seat and with the corresponding end of the outer tube which is peripherally fixed sealingly on the outlet end plate for connection to said seat so as to define a cavity which is an extension in the seat of the cavity of the double-walled tube around the outlet end of the inner tube, in the outlet end plate there being at least one conduit which emerges inside the cavity for the passage of the cooling fluid which flows inside the cavity of the double-walled tube.

21. The exchanger according to claim 14, wherein the outlet is enclosed by an ellipsoidal chamber with an inspection cover, which is preferably flat and has an ellipsoidal shape.

22. The exchanger according to claim 14, wherein at the end of the exchanger which is the inlet for the fluid to be cooled there are, for each double-walled tube, the connecting elements with a Y-section connected to the passages so as to allow the transit of the fluid to be cooled towards the inner tubes.

* * * * *